United States Patent [19]

Cashman et al.

[11] Patent Number: 4,978,443

[45] Date of Patent: Dec. 18, 1990

[54] SEPARATOR DISC

[75] Inventors: Stephen L. Cashman, Columbia Heights; Edward L. Commers, Brooklyn Center, both of Minn.

[73] Assignee: Carter-Day Company, Minneapolis, Minn.

[21] Appl. No.: 353,808

[22] Filed: May 18, 1989

[51] Int. Cl.[5] ..... B07B 5/00

[52] U.S. Cl. ..... 209/684; 209/931

[58] Field of Search ..... 209/684, 686, 672, 361, 209/931

[56] References Cited

U.S. PATENT DOCUMENTS

| | | | |
|---|---|---|---|
| 415,275 | 11/1989 | Kehlor | 99/605 |
| 1,364,247 | 1/1989 | Carter | 209/684 |
| 1,390,806 | 9/1921 | Miller | 209/684 |
| 1,437,042 | 11/1922 | Carter | 209/684 |
| 1,612,242 | 12/1926 | Viguerie | 209/684 |
| 2,707,554 | 5/1955 | Dempsey | 209/684 X |

FOREIGN PATENT DOCUMENTS

| | | | |
|---|---|---|---|
| 689498 | 2/1930 | France | 209/684 |
| 225724 | 12/1924 | United Kingdom | 209/684 |

*Primary Examiner*—Donald T. Hajec

*Attorney, Agent, or Firm*—Dorsey & Whitney

[57] ABSTRACT

A separator disc for use in a disc separator for separating a mixture of grain and/or grain-like particles according to particle length. The disc separator, of conventional construction, is characterized by a series of spaced parallel discs, mounted for rotation on a common shaft. The discs are partially submerged in the mixture. Pockets in the exposed plane surfaces of the discs lift shorter grains from the mixture and dump them as the discs rotate, to thereby separate the particles. The separator disc is formed of a castable polyurethane material and is radially split to provide for removal from the shaft and replacement of individual discs in a direction transverse to the axis of the shaft.

8 Claims, 7 Drawing Sheets

SEPARATOR DISC

BACKGROUND OF THE INVENTION

The invention is an improved separator disc for use in mechanical separation of grain and grain-like particles according to particle length. It is particularly useful in separating cereal grains, rice, seeds and other grain-like particles that are mixed or comingled so that, for example, rice grains are separated from oats.

The invention is in the field of separation by a series of spaced parallel discs rotating on a common shaft. The discs are formed with pockets in the exposed plane surfaces. Approximately the lower third of each disc is submerged in and rotates through the grain or seed mixture. Shorter grains are lodged in the pockets in the disc and are lifted from the mixture or pool of mixed grain and are dumped above the mixture as the disc rotates, to separate grains and/or grain-like particles all in the conventional manner.

For more than seventy years disc separators have been constructed with one-piece separator discs made from cast iron. Such discs are shown and described in early U.S. patents issued to the predecessor-in-interest of the assignee of the present application, namely, Carter U.S. Pat. No. (1,364,247) and Carter U.S. Pat. No. (1,437,042). The disc separators shown in these patents, as well as those shown and described in other prior art patents, such as Kehlor U.S. Pat. No. (415,275), Miller U.S. Pat. No. (1,390,806) and Dempsey U.S. Pat. No. (2,707,554), are characterized by a series of one-piece, cast-iron discs mounted in spaced parallel relationship for rotation on a common shaft.

The cast iron construction makes the discs extremely heavy, makes the casting process somewhat complicated, and results in discs that are subject to wear, which requires periodic replacement of worn discs. When a worn disc is replaced, the one-piece construction of the discs requires that the worn disc be moved axially along the shaft and the new replacement disc moved axially along the shaft in the opposite direction into its proper position. This requires removal of each disc between the worn one and the end of the shaft. In the case of the innermost discs on the shaft as many as 30 discs might have to be removed to allow removal and replacement of the worn disc. This is a substantial amount of work. In addition to removal of unworn discs, the shaft must also be removed from its bearings or mounting brackets to allow the worn disc to pass beyond the end of the shaft and be removed. These disadvantages have existed, have been recognized, and have gone without solution for seventy years.

The Williams U.S. Pat. No. (4,795,036) teaches a split cast-iron disc in the context of a rotary disc screen conveyor apparatus, and teaches removal and replacement of the discs with different size discs for screening and conveying different sized objects, but does not teach use of the split-ring design in a disc separator for separation of grain and grain-like particles according to particle lengths, nor does Williams teach the light weight separator disc of the present invention.

The present invention fulfills the long-felt need for elimination of the disadvantages associated with the one-piece, cast iron separator disc. It results in a much lighter disc that can be molded more cheaply, provides for less wear, less plugging, and provides for dissipation of static electricity (like the cast iron discs). In addition it can be removed individually from the shaft in a direction transverse to the axis of the shaft without the need to remove other discs on the shaft.

SUMMARY OF THE INVENTION

The invention is an improved separator disc for use in a disc separator for separating a mixture of grain and/or grain-like articles according to particle length. The disc separator is characterized by a series of spaced, parallel discs partially submerged in the mixture, rotating on a common shaft, with pockets in the exposed plane surfaces of each disc for lifting and dumping particles of a certain length lodged therein, to thereby separate said particles from longer particles as the discs rotate. The improved discs are formed of a castable polyurethane material having a hardness in the range of 50–100 on the Shore "A" scale, a static dissipative conductivity rating and a non-porous finish. Most typically, the polyurethane material is formed from an isocyanate, a backbone selected from the group consisting of a polyester, a polyether or a polycaprolactone, and a hydroxyl or amine curing agent.

The discs are radially split to allow removal of the discs from the shaft in a direction transverse to the axis of the shaft, without requiring removal of other discs between the one to be removed and the end of the shaft, or removal of the shaft from its bearings or mounting bracket.

In the preferred embodiment the discs are formed in two radially divided sections which can be separated so that each section can be removed in a direction transversely to the shaft and replaced in the opposite direction.

DESCRIPTION OF THE PREFERRED EMBODIMENT

Figure 1:
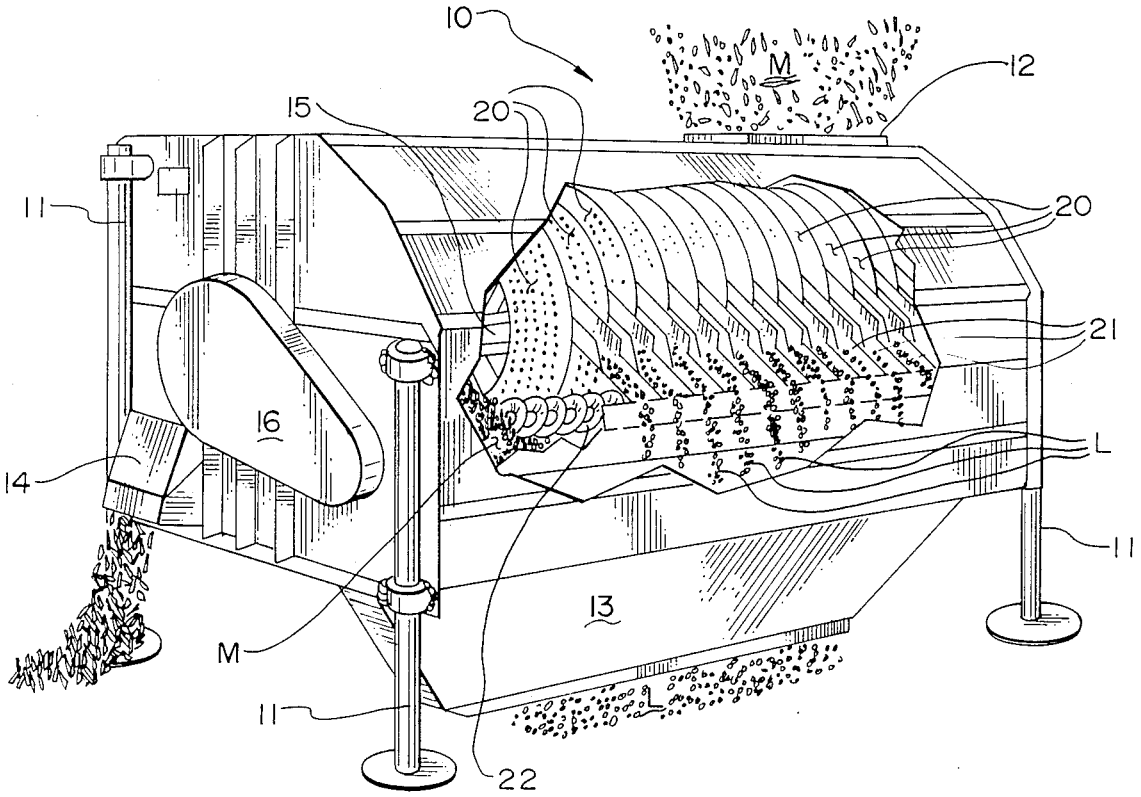
FIG. 1 is a perspective view of a conventional disc separator with a portion of one side cut away to show the series of improved separator discs of the present invention mounted on shaft of the separator.

A conventional disc separator with which the improved separator disc of the present invention is used is shown in FIG. 1. The disc separator 10 is mounted on legs 11, and includes a mixed grain inlet 12, a liftings or short-grain discharge hopper 13 and a tailings or long-grain discharge spout 14. Shaft 15 is driven by a drive motor (not shown) connected by a V-belt (not shown), all covered by V-belt shroud 16. A series of separator discs 20 is mounted in spaced parallel relationship on drive shaft 15. Discharge troughs 21 are disposed between separator discs 20 and a screw conveyor or auger 22 is provided to move the mixed grain or tailings toward discharge spout 14.

The conventional disc separator of FIG. 1 is typically formed with 20–66, twenty-five inch diameter, cast-iron separator discs 20, which weigh 25–30 pounds each and which rotate at 48–55 r.p.m.

In operation mixed grain, M, is fed into the separator at mixed grain inlet 12 and forms a pool or mixture in the separator below shaft 15. Separator discs 20 rotate on shaft 15 in a clockwise direction as viewed from the left end of the separator in FIG. 1. Short grain or liftings, L, are picked up or lifted in the pockets of the separator discs 20 and are dumped or discharged into discharge troughs 21 and into liftings hopper 13. Long grains or tailings, T, are not lifted and remain in the pool or mixture, M, beneath shaft 15 and are eventually discharged from tailings spout 14.

All of the foregoing is conventional disc separator construction and operation.

The present invention consists of a novel substance from which the separator disc 20 is formed and a novel construction of the disc 20 characterized by a split disc, which can be removed transversely from shaft 15.

The separator disc 20 of the present invention is formed of a castable polyurethane material consisting of an isocyanate, a polyester, polyether or polycaprolactone backbone and a hydroxyl or amine curing agent. More specifically the material is an isocyanate terminated polytetra methylene glycol polyether, cured with a 4,4 prime methylene Bis-2-chloroaniline. The hardness desired is in the range of 50–100 on the Shore "A" scale and preferably about 90. Those skilled in the art may select proportions to yield the desired hardness. The cast finished disc is typically oven cured for 45 minutes at 210° F. A non-porous finish is desired.

The Shore hardness test is well known in the plastic molding or casting art and is a standard test procedure developed and published by the Shore Instrument and Manufacturing Company, Burger Instrument Division, Freeport, N.Y.

In grain milling and handling activity the dissapation without sparking of static electricity is critical. The dusty atmosphere generated by the activity can be ignited by a spark, causing an explosion and fire with often fatal results to those working in the area. Consequently, the discs of the invention are formulated with a carbon-black component to give them a static dissapative conductivity rating, an essential requirement for safety purposes. Those skilled in the art may select a suitable amount of carbon black for inclusion in the molding process.

In addition to being formed of a light weight polyurethane material with greatly improved wear characteristics, the improved disc of the present invention is split to allow removal and replacement transversely of the shaft of a worn or damaged disc.

Figure 2:
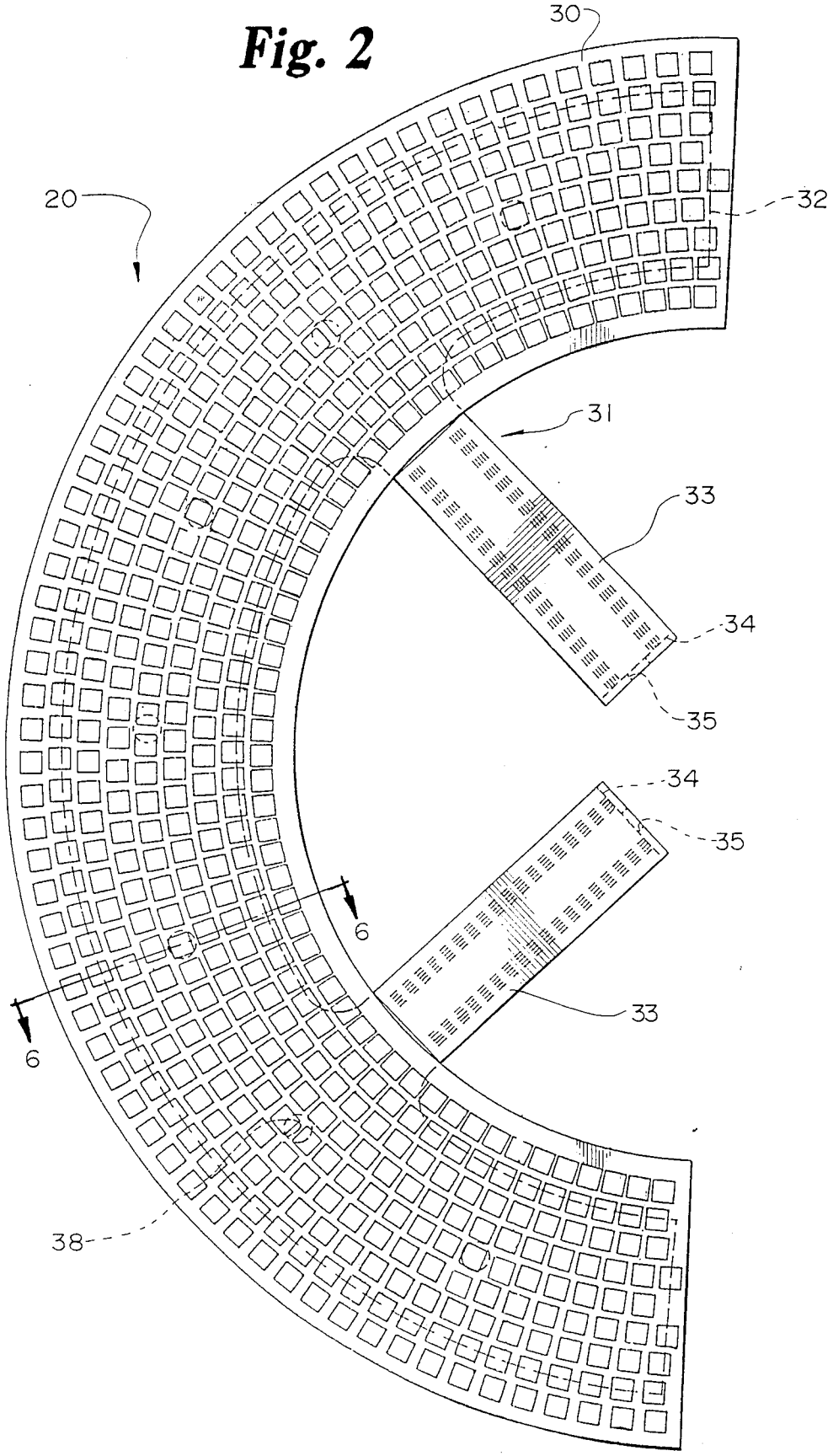
FIG. 2 is a front view of the preferred embodiment of a separator disc half.
Figure 3:
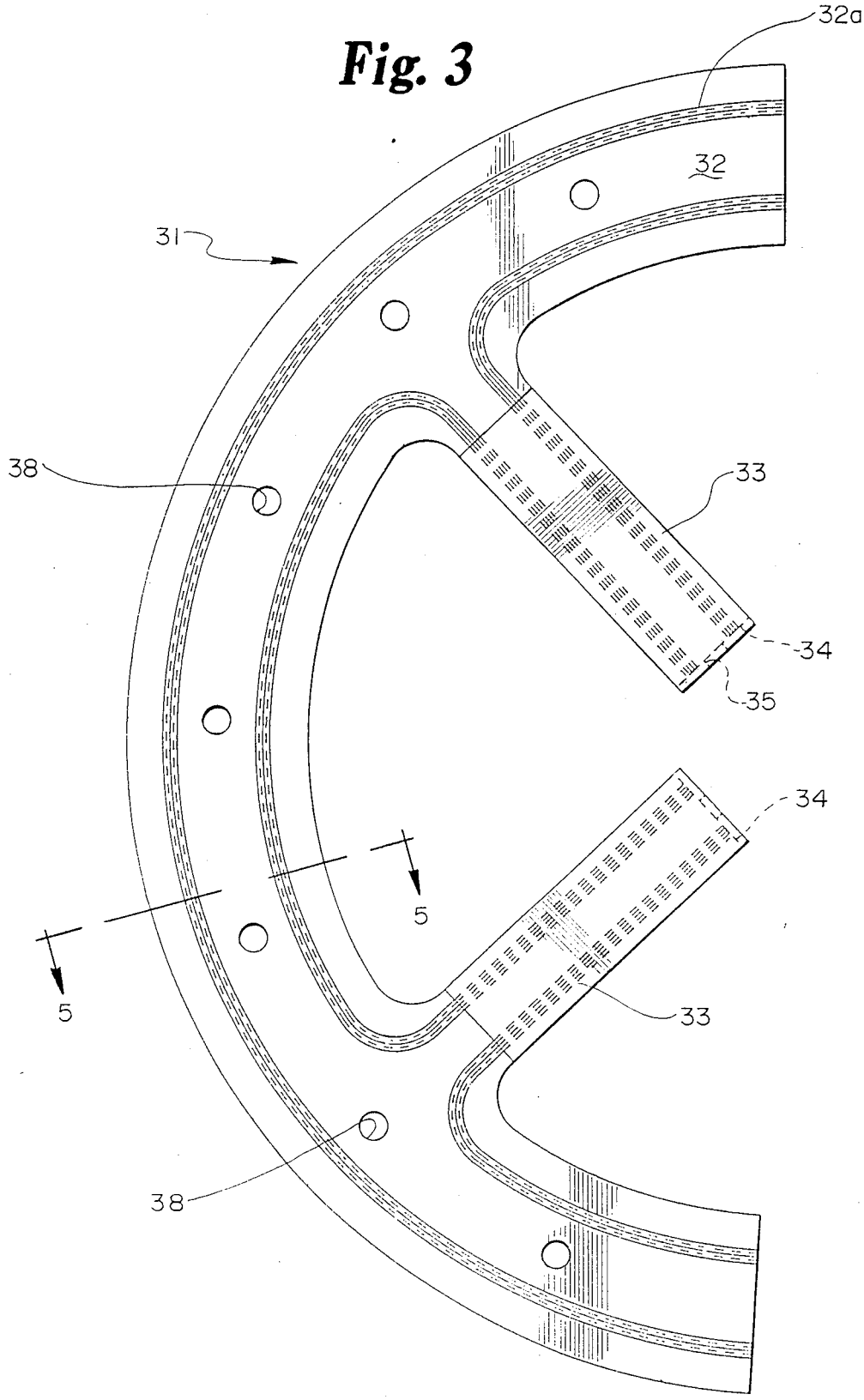
FIG. 3 is a front view of the backing plate of the preferred of separator disc half.
Figure 4:
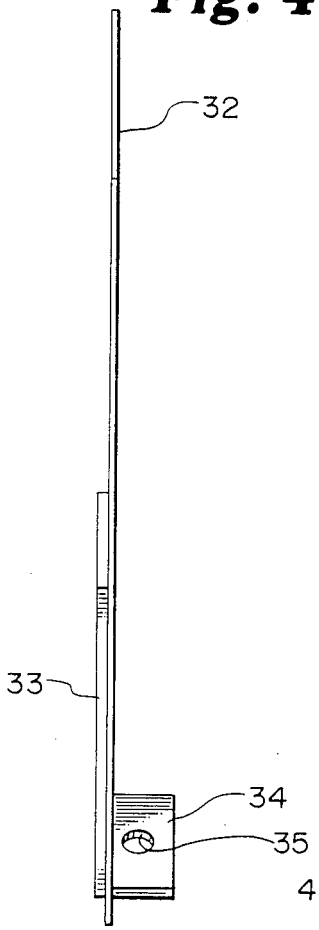
FIG. 4 is an end view of the separator disc half of FIG. 3.
Figure 5:
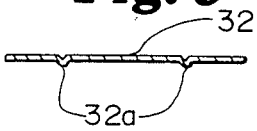
FIG. 5 is a sectional view of the separator disc backing plate taken on the line 5—5 of FIG. 3.
Figure 6:
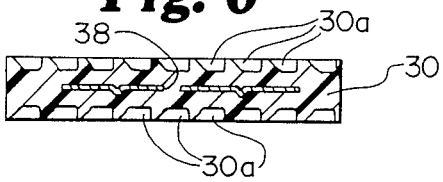
FIG. 6 is a sectional view of the separator disc half taken on the 6—6 of FIG. 2.
Figure 7:
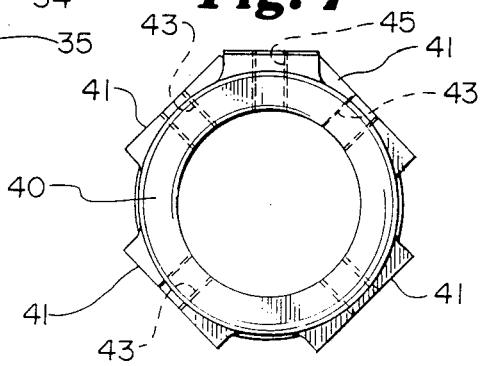
FIG. 7 is an end view of the mounting hub for attaching the separator disc halves of FIGS. 2–6 to the shaft of a disc separator.
Figure 8:
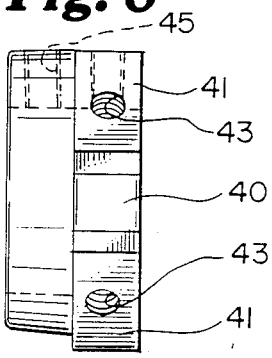
FIG. 8 is a side view of the hub of FIG. 7.

The preferred form of split disc is shown in FIGS. 2–10. One-half of disc 20 is shown in FIG. 2. It consists of molded disc plate 30 which is molded onto backing plate 31, which includes semi-circular section 32 and radial arms 33. Arms 33 are formed with flanges 34 and mounting holes 35 shown in FIGS. 2–4. Disc plate 30 is formed of polyurethane as explained above, and is of conventional configuration with pockets 30*a*, shown in front view in FIG. 2, distributed substantially uniformly over the exposed plane surface of disc plate 30. Pockets 30 are shown in section in FIG. 6. Pockets 30*a* are of conventional size and configuration and serve to pick up shorter grains in pockets 30*a* and dump them when the disc pockets approach a 180° position change as discs 20 rotate on shaft 15.

The semi-circular section 32 of backing plate 31 is formed with corrugations 32*a* which serve to position and anchor cast disc plate 30, which is cast directly onto and around disc section 32. Holes 38 of cast disc plate 30, through semi-circular section 32, provide for flow through of the liquid, uncured plastic material to further anchor disc plate 30 onto backing plate 31.

Figure 9:
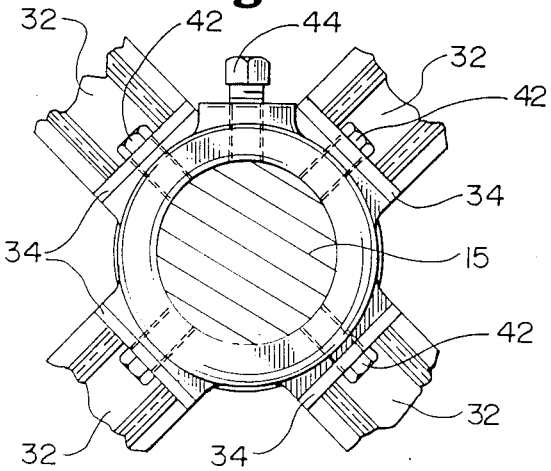
FIG. 9 is an end view of the hub of FIG. 7 with the radial arms of the separator disc halves mounted thereto and with the hub mounted on the shaft of a disc separator.
Figure 10:
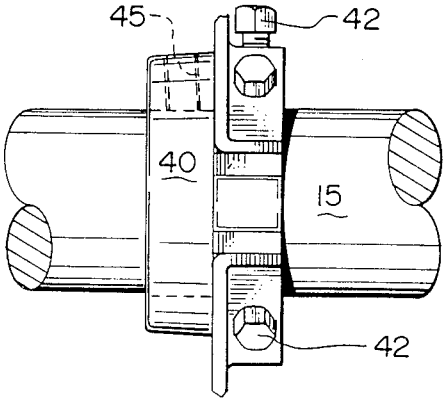
FIG. 10 is a side view of the shaft, hub and radial arms shown in FIG. 9.

The one-half disc section 20 shown in FIG. 2 is mated with an identical disc section and mounted on shaft 15 of disc separator 10 by means of collar 40, which has four 90°, angularly-spaced, tapped, flange seats 41. Collar 40 also is tapped for a set screw. The half disc sections are mounted on collar 40 by tap bolts 42 which extend through opening 35 in flanges 34 into tapped bores 43 as shown in FIGS. 9 and 10. Collar 40 is fixed on shaft 15 by means of set screw 44 threaded into tapped bore 45.

Another embodiment of disc 20 is shown in FIGS. 11–15. The embodiment of FIGS. 11–15 consists of a single-piece split disc, as distinguished from the two-piece, split-disc construction of FIGS. 2–10.

Figure 11:
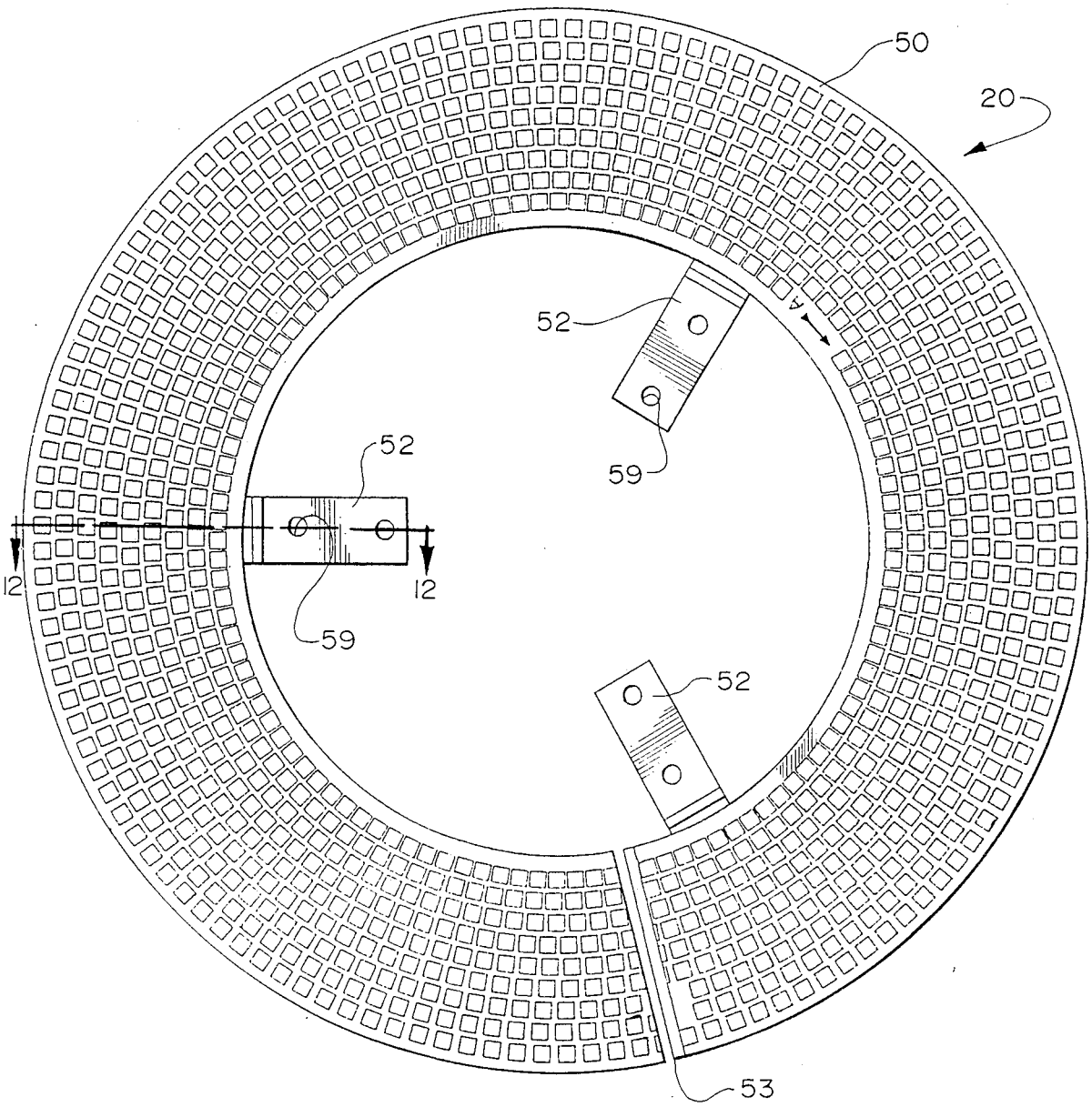
FIG. 11 is a front view of an alternative embodiment of the separator disc of the present invention.
Figure 12:
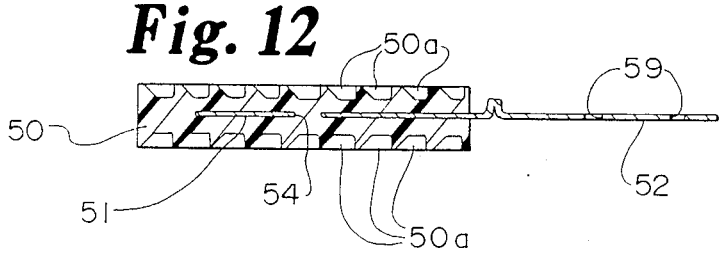
FIG. 12 is a sectional view of the separator disc of FIG. 11 taken on the line 12—12 of FIG. 11.
Figure 13:
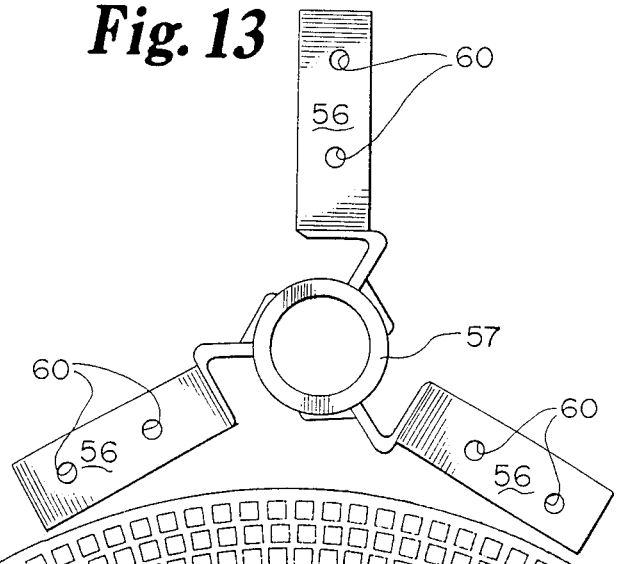
FIG. 13 is an end view of the hub and radial arms for mounting the separator disc of FIGS. 11 and 12 to the shaft of a disc separator.
Figure 14:
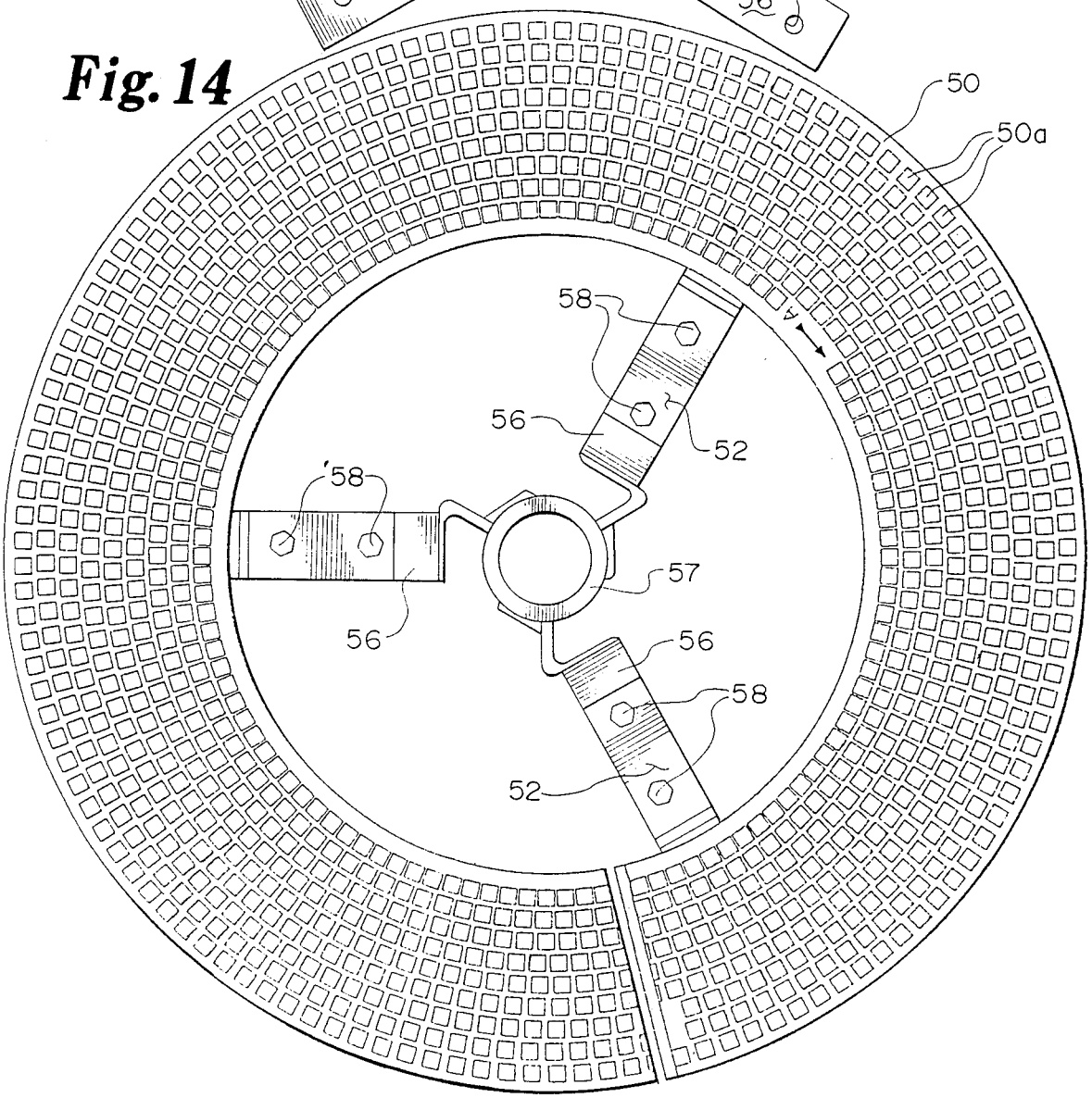
FIG. 14 is a front view of the separator disc of FIG. 11 mounted on the hub and radial arms of FIG. 13 and the shaft of a disc separator.

With reference to FIGS. 11 and 12, disc 20 is formed from a single cast disc plate 50, which has pockets 50*a* of conventional size, configuration and distribution on both of the exposed plane surfaces of cast disc plate 50. Disc plate 50 is cast onto a backing plate 51, best seen in FIG. 12, which has three radially extending arms 52. Disc plate 50 is split at 53 for removal from shaft 15 as explained in more detail below.

Cast disc plate 50 is made from polyurethane plastic as explained above and, like disc plate 30 of FIGS. 2–10, is cast directly onto backing plate 51. Flow through openings 54 are provided in backing plate 51 to assist in anchoring disc plate 50 to backing plate 51.

Disc plate 50 is mounted on shaft 15 of disc separator 10 by bolting arms 52 of backing plate 51 to corresponding spokes 56 welded to and extending radially from hub 57. Tap bolts 58 extend through openings 59 of arms 52 and thread into tapped bores 60 in spokes 56 for that purpose.

Figure 15:
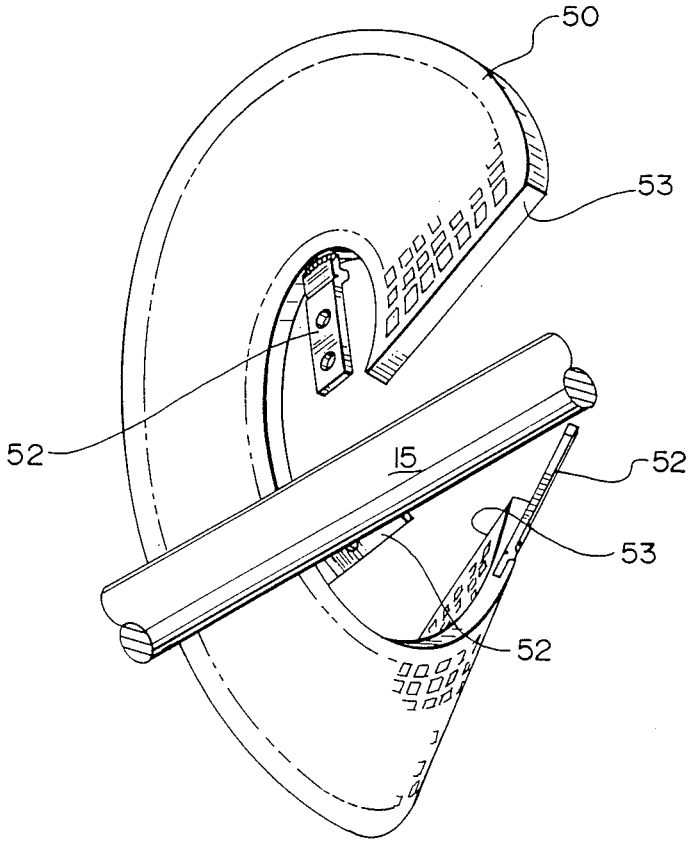
FIG. 15 is a perspective view of the separator disc of FIG. 11, removed from the radial arms of FIGS. 13 and 15, and distorted for removal from the shaft of the separator in a direction transverse to the axis of the shaft.

Disc plate 50 can be removed from shaft 15 transversely from the shaft by removing tap bolts 58 and bending or distorting disc plate 50 as shown in FIG. 15, separating disc plate 50 at split 53, and pulling disc plate 50, including backing plate 51, off shaft 15 in a direction transverse to the axis of the shaft. A new disc is mounted on shaft 15 in opposite manner.

Both cast disc plate 30 of FIGS. 2–10 and cast disc plate 50 of FIGS. 11–15 can be individually removed and replaced from shaft 15 of disc separator 10 without removing other discs on the shaft. In the case of cast disc plate 30, tap bolts 42 are removed and the two sections of disc plate 30 can be removed in a direction transverse to the axis of shaft 15. One or both halves can be replaced. In the case of cast disc plate 50, tap bolts 58 are removed, disc plate 50 and its backing plate 51 are bent or distorted as shown in FIG. 15, and removed from shaft 15. Thus, the prior art problem of having to remove all of the single 1 piece cast iron discs between the worn disc and the end of the shaft, and having to remove the shaft from its bearings in order to slide all the discs axially off the shaft is eliminated.

In addition the polyurethane construction of disc plates 30 and 50 removes considerable weight, increases wear and decreases packing or plugging of the lifting pockets. The invention thus fills a long-felt need in the disc separator art.

Those skilled in the art may devise variations in the design and construction of the present invention as compared to the foregoing description. Such variations are considered to be within the scope of the invention if within the scope of the following claims.

We claim:

1. In a disc separator for separating a mixture of particles according to particle size, characterized by a series of spaced, parallel discs partially submerged in the mixture for rotation on a common axis, each of the discs having a series of pockets distributed substantially uniformly over the exposed plane surface thereof for lifting from the mixture particles of a certain size lodged therein as the discs pass through the mixture, and dumping the particles above the mixture as the discs rotate to thereby separate said particles from larger particles in the mixture, the improvement comprising:

discs formed of a castable polyurethane material having a hardness in the range of 50–100 on the Shore "A" scale, a static dissipative conductivity rating and a non-porous finish.

2. The disc separator of claim 1 wherein the polyurethane material is formed from an isocyanate, a backbone selected from the group consisting of a polyester, a polyether or a polycaprolactone, and a hydroxyl or amine curing agent.

3. The disc separator of claim 2 wherein the polyurethane material consists of an isocyanate terminated polytetra methylene glycol polyether.

4. The disc separator of claim 3 wherein the polyurethane material is cured with 4,4 prime methylene Bis-2-chloroaniline.

5. The disc separator of claim 1 wherein the discs are radially split to thereby allow the discs to be removed from the shaft in a direction transverse to the axis of the shaft.

6. The disc separator of claim 2 wherein the discs are radially split to thereby allow the discs to be removed from the shaft in a direction transverse to the axis of the shaft.

7. The disc separator of claim 3 wherein the discs are radially split to thereby allow the discs to be removed from the shaft in a direction transverse to the axis of the shaft.

8. The disc separator of claim 4 wherein the discs are radially split to thereby allow the discs to be removed from the shaft in a direction transverse to the axis of the shaft.

* * * * *